US007059943B2

(12) United States Patent
Cann et al.

(10) Patent No.: US 7,059,943 B2
(45) Date of Patent: Jun. 13, 2006

(54) METHOD AND APPARATUS FOR RECYCLING SLURRY

(75) Inventors: Scott Cann, Washougal, WA (US); Michael Huston, Vancouver, WA (US); Sergey N. Altukhov, Vancouver, WA (US)

(73) Assignee: SEH America, Inc., Vancouver, WA (US)

( * ) Notice: Subject to any disclaimer, the term of this patent is extended or adjusted under 35 U.S.C. 154(b) by 1017 days.

(21) Appl. No.: 09/893,928

(22) Filed: Jun. 28, 2001

(65) Prior Publication Data

US 2003/0003851 A1 Jan. 2, 2003

(51) Int. Cl.
*B24B 1/00* (2006.01)

(52) U.S. Cl. ..... 451/44; 451/54; 451/287

(58) Field of Classification Search ..... 451/54, 451/44, 60, 287, 446; 210/743, 688, 663, 210/739, 689, 96.1, 631, 167, 196, 266, 416.1, 210/681; 438/692, 693

See application file for complete search history.

(56) References Cited

U.S. PATENT DOCUMENTS

| | | | |
|---|---|---|---|
| 5,203,121 | A | 4/1993 | Metzger |
| 5,664,990 | A | 9/1997 | Adams et al. |
| 6,106,728 | A | 8/2000 | Iida et al. |

*Primary Examiner*—Joseph J. Hail, III
*Assistant Examiner*—Alvin J Grant
(74) *Attorney, Agent, or Firm*—Alston & Bird LLP

(57) ABSTRACT

A slurry recycling apparatus having a first filter, a dirty side storage tank, slurry pump, second filter, clean side storage tank and slurry outlet, in which used slurry from an edge notch polishing apparatus is delivered to the first screen filter, transported to the dirty side slurry storage tank, pumped from the dirty side slurry storage tank through a second filter that filters out small particulate matter from the slurry and allows the slurry to pass to the clean side slurry storage tank, and finally to the edge notch polishing apparatus as needed. Slurry which is not immediately taken from the clean side slurry storage tank is continuously recycled through the second filter by overflowing from the clean side to the dirty side slurry storage tank where it is there pumped through the second filter back into the clean side slurry storage tank.

23 Claims, 2 Drawing Sheets

METHOD AND APPARATUS FOR RECYCLING SLURRY

FIELD OF THE INVENTION

The present invention relates to recycling of slurry from a edge-notch polishing apparatus.

BACKGROUND OF THE INVENTION

Prior to the production of integrated circuits, the semiconductor wafer upon which they are based is cut from a large silicon crystal. The wafer, which usually has a circular cross-section, has an upper surface, a lower surface, and an edge about the periphery of the wafer. Each of the surfaces and the edge of the wafer are processed prior to the lithographic processes which build integrated circuits upon the silicon wafer.

To assist in the rotational alignment of the wafer, a flat section or notch is ground into the edge of the wafer before photolithographic processing. The wafer must be repeatedly positioned and repositioned with tremendous precision so that the photolithographic processes will be properly aligned upon the wafer's surface and, more particularly, will be aligned with respect to the crystalographic planes of the wafer. With reference to the flat or notch (hereinafter collectively referred to as a "notch"), the wafer may be easily aligned.

As mentioned, the roughly cut wafer must be ground into its desired shape. Grinding of the edge gives the wafer its circular cross-section, but leaves a relatively rough and uneven surface along the edge of the wafer. Grinding of the notch into the edge of the semiconductor wafer also leaves a rough and uneven surface within the notch. The rough surface left after grinding of the edge or notch can, therefore, cause a variety of problems in future process steps. First and foremost, the grinding operation may cause particles to become trapped within the microstructure of the wafer. During subsequent processing steps, the trapped particles might leach out of the wafer and contaminate the wafer surface or the delicate wafer producing components. Also, physical abuse during grinding may cause local dislocations upon the surface of the edge or notch. The dislocations can potentially propagate into the wafer during subsequent high temperature processing steps, thereby harming the wafer and the integrated circuit based thereupon. Finally, residual material from the roughly ground edge or notch may become free during future processing and interfere with the lithographic process. Rough surfaces within a notch are particularly problematic because automated wafer handling devices repeatedly engage the notch during circuit processing and tend to dislodge any uneven fragments of silicon along the surface of the notch.

In order to avoid the problems associated with roughly ground edges and notches, silicon wafers are routinely polished along their edges or notches. Polishing is most typically done with a buffing wheel supplied with an abrasive slurry which polishes and smoothes the edge and notch surfaces of the wafer. Polishing of the edge and notch tends to remove any of the dislocations within the edge surface of the wafer, as well as removing protruding portions of the edge.

The slurry used in polishing the edge of the wafer is typically recycled by a slurry recycling apparatus which collects the used slurry from the wafer, filters the used slurry, and returns the slurry to the buffing or polishing pad. Continuous recycling and filtration of the polishing slurry theoretically leads to an uninterrupted supply of slurry. In commercial use, however, problems with proper filtration of the slurry material have plagued the industry. Improper filtration results in damage to the precision flow meters and other instrumentation used in monitoring slurry flow to the edge-notch polishing pad. When flow meters or other equipment are damaged by improper filtration, wafer processing must be suspended while the instrumentation is repaired or replaced.

Existing slurry filtering apparatuses consist of a gravity fed screen filter leading into an agitated tank. The polishing pad is supplied slurry from the agitated tank. The existing process has been ineffective at the reliable removal of polishing pad material and silicon material removed from the edge of the wafer. As such, contaminants such as the polishing pad material and silicon material previously removed from the edge of the wafer are recirculated to the edge-notch polishing pad. There contaminants can then prevent effective polishing of the edge.

An edge-notch polishing slurry recycling apparatus and method are needed to remove polishing pad material and large silicon material from the polishing slurry so that flow meters and other instrumentation within the recycling loop are not damaged and so that undesired particulate materials do not reach the edge-notch polishing pad, potentially harming the wafer. A slurry recycling apparatus and method is further needed that provides for continuous monitoring and maintenance of the slurry recycle apparatus so that interruptions in wafer processing are minimized.

SUMMARY OF THE INVENTION

The present invention provides an apparatus and method of recycling slurry from an edge-notch polishing apparatus, which more effectively removes polishing pad material and silicon material from the slurry used in polishing the edge or notch of a silicon wafer. The improved recycling of the slurry is achieved by a unique arrangement of filters, tanks, and pumps, which provide continual filtration of the slurry material and the ability to exchange filters during continued operation of the polishing process. The slurry recycling apparatus and method also minimizes down time due to damaged flow meters and other sensitive equipment caused by ineffective removal of large particulate matter within the recycling of slurry.

The slurry recycling apparatus and method are designed for use with an edge or notch polishing apparatus in the production of semiconductor wafers. The basic components of the recycling apparatus are a first filter, a dirty side storage tank, slurry pump, second filter, clean side storage tank, and slurry outlet. Used slurry from an edge-notch polishing apparatus is delivered to the first screen filter, which filters out large particulate matter from the slurry. The used slurry is then transported to the dirty side slurry storage tank. The used slurry is then moved by a slurry pump from the dirty side slurry storage tank through a second filter that filters out small particulate matter from the slurry and allows the slurry to pass to the clean side slurry storage tank. As recycled slurry is needed by the edge-notch polishing apparatus, it is taken from the clean side slurry supply tank by a slurry supply line. During recycling, clean side slurry is continuously overflowed into the dirty side slurry storage tank. In this manner, slurry which is not immediately taken from the clean side slurry storage tank is continuously recycled through the second filter by overflowing from the clean side to the dirty side slurry storage tank where it is then pumped through the second filter back into the clean side slurry storage tank.

In an embodiment, the second filter is removable and may be cleaned or replaced during operation of the recycling apparatus simply be deactivating the slurry pump and allowing used slurry to collect in the dirty side slurry storage tank and recycled slurry to be supplied by the clean side slurry storage tank. Such an arrangement allows for the second filter to be routinely cleaned or replaced without interruption to the recycling process. In another embodiment, the slurry pump is of a capacity that provides constant overflow of slurry from the clean side to the dirty side slurry storage tank so that slurry which is not used by the edge notch polishing apparatus will be continually filtered through the second filter between the dirty side and clean side slurry storage tanks.

The invented slurry recycling apparatus and method allows for the continuous recycling of slurry without the necessity for discontinued recycling upon filter maintenance or replacement. Also, the slurry pump and second filter arrangement allows for higher pressure filtration, and therefore, the removal of smaller particulate matter from the slurry. Finally, the overflow arrangement of the clean side and dirty side slurry storage tanks allows for continuous recycling of slurry material since the slurry material is continuously filtered through the slurry pump and second filter when not completely utilized by the edge-notch polishing apparatus.

BRIEF DESCRIPTION OF THE DRAWINGS

Figure 1:
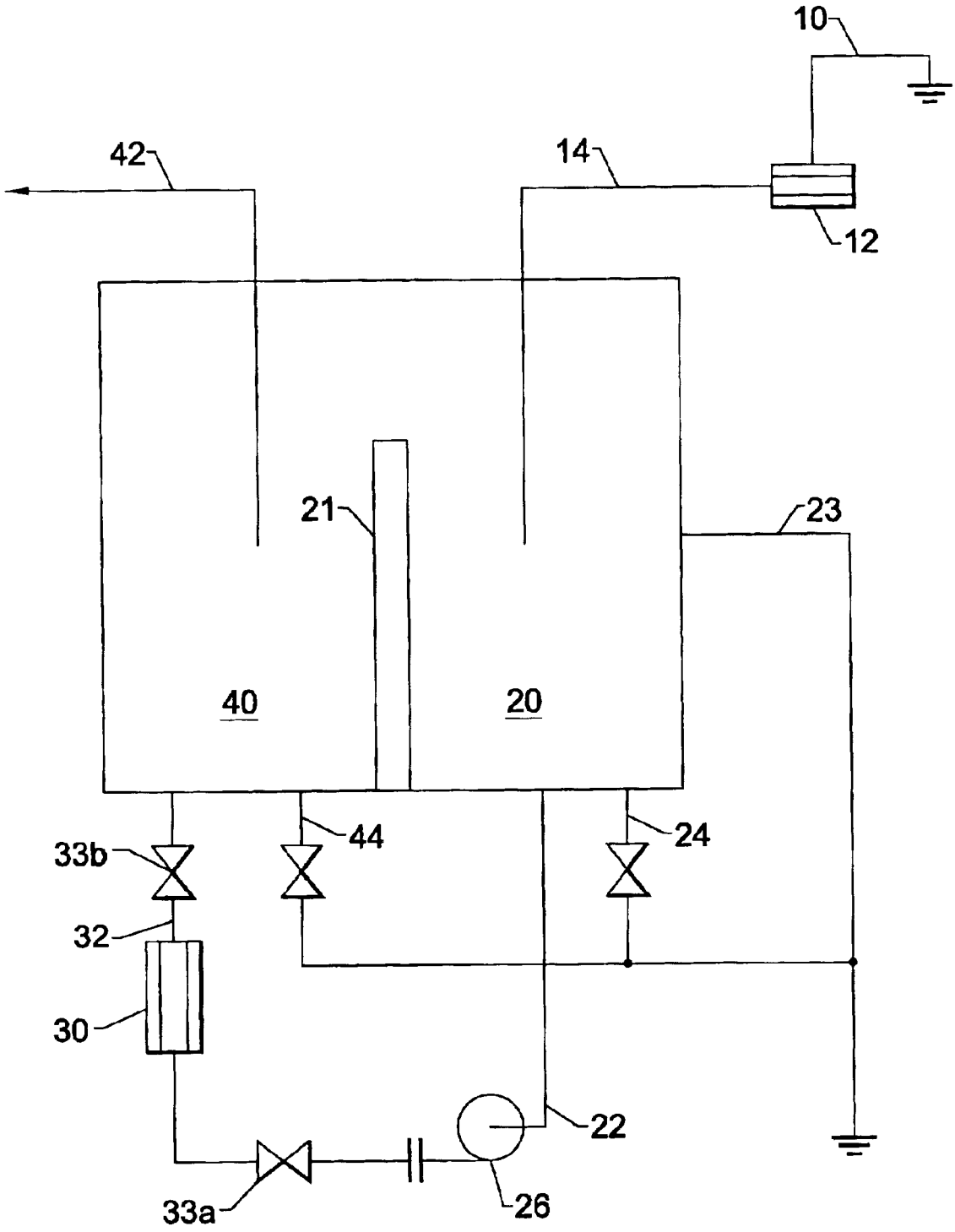

Having thus described the invention in general terms, reference will now be made to the accompanying drawings, which are not necessarily drawn to scale, and wherein:

FIG. 1 is a schematic view of an embodiment of the invented slurry recycle apparatus.

Figure 2:
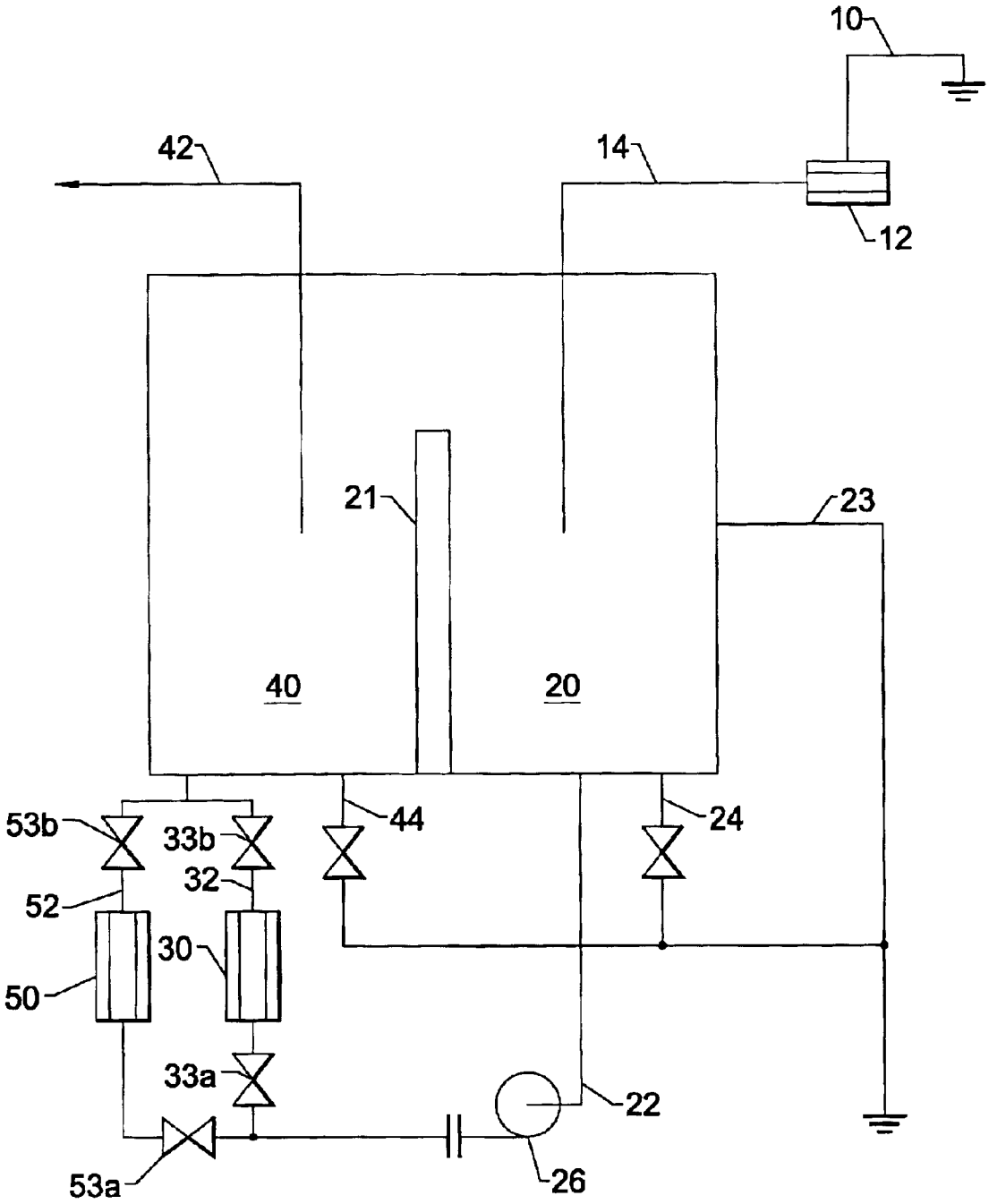

FIG. 2 is a schematic view of an alternative embodiment of the invented slurry recycle apparatus.

DETAILED DESCRIPTION OF THE INVENTION

The present invention now will be described more fully hereinafter with reference to the accompanying drawings, in which preferred embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art. Like numbers refer to like elements throughout.

Referring to FIG. 1, an embodiment of the invented edge-notch polishing slurry recycling apparatus is shown. The recycling apparatus consists primarily of a first filter 12, a dirty side slurry supply tank 20, a pump 26, a second filter 30, and a clean side slurry supply tank 40. The apparatus is arranged such that used slurry is initially filtered through filter 12 and transported to a "dirty" tank 20. Slurry is then pumped from the dirty tank 20, through a second filter 30, and into a "clean" tank 40. In operation of the apparatus, slurry from the clean tank may be transported back to the dirty tank so that the slurry may be repeatedly pumped and filtered through the second filter 30.

Used slurry enters the apparatus by a dirty slurry supply line 10 which is fed by some type of dirty slurry collection system which collects dirty slurry from the edge-notch polisher. The used slurry, which is usually a mixture of colloidal silica and sodium hydroxide, contains fragments of silicon which were removed from the silicon wafer during the polishing operation as well as fragments of the polishing pad, typically cotton cloth or felt, that were worn off of the pad during polishing. It is the fragments of silicon and the polishing pad material which may damage the components of the slurry recycling apparatus and the silicon wafer if not effectively removed by the recycling apparatus.

The dirty slurry supply line 10 feeds the first filter 12 of the apparatus, which removes fragments of material having a predetermined size from the slurry. The first filter 12 has a relatively large pore size of between about 0.2 mm and about 0.8 mm, with a preferred pore size of between about 0.4 mm and about 0.6 mm. The filter 12 is constructed of any material inert to sodium hydroxide and capable of filtering silicon materials, and is preferably a nylon mesh filter. The first filter 12 removes large particles which can easily be removed from the slurry without the need for a pressurized input in order to maintain an acceptable throughput of slurry. The filter 12 is preferably gravity fed, which simplifies the apparatus and minimizes the maintenance required for operation of the first filter 12. Alternatively, the feed 10 is pressurized, allowing for the use of a filter 12 having decreased porosity.

Slurry filtrate from the first filter 12 is conducted by piping 14 to the dirty side slurry storage tank 20. The dirty tank 20 is any specially made or commercially available container which is not abraded by or reactive with the slightly acidic or slightly basic abrasive slurry. For use with a sodium hydroxide slurry, the dirty tank 20 would obviously be resistant to attack by caustic substances. The dirty tank 20 has at least one pump feed line 22 leading from a lower portion of the dirty tank 20 to a slurry pump 26. Preferably, the dirty tank 20 also has a valved drain line 24, which leads from the lower portion of the dirty tank 20 to a main drain line, and a secondary drain 23 which leads from the upper portion of the dirty tank 20 to the main drain line. Drain line 24 is used to empty the dirty tank 20 during maintenance of the apparatus, while secondary drain 23 prevents the slurry level of the dirty tank 20 from reaching a level that would allow accidental backflow into the clean tank 40. The dirty tank 20 has sufficient volume to allow for several minutes of slurry accumulation without the need to drain the slurry. The spare volume is used during exchange of the second filter 30, discussed below.

Slurry is conducted out of the dirty tank 20 by the pump feed line 22 to the slurry pump 26. The slurry pump 26 may be any commercially available pump such as a mechanically, electrically, or pneumatically driven pump capable of continuously pumping a slurry liquid. The primary purpose of the pump 26 is to provide a supply of slurry with sufficient pressure to pass through the second filter 30. Though flow rates and pressures may vary depending on the overall size of the slurry recycling unit, a preferred flow rate of slurry leaving the pump 26 is between about 0.4 and about 2.0 liters/min.

The second filter 30 removes particles of a much smaller predetermined size than those removed by the first filter 12 and has a much lower porosity than the first filter 12, about 10 μm to about 30 μm, and preferably about 20 μm. The preferred 20 μm filter causes a 5 psi drop of slurry supply pressure across the filter. Therefore, the increased pressure provided by the pump 26 is required to provide a sufficient throughput of slurry through the second filter 30. The second filter 30 is easily replaceable, and may be either cleaned or replaced within a short period of time. The second filter 30 is preferably a cartridge type filter which may be easily interchanged and is preferably a polypropylene filter, though any similar material resistant to caustic attack may be used. Regular cleaning and replacement of the second filter 30 prevents oversized particulates from working past the filter and continuing on into the clean side slurry storage tank 40.

The slurry is more effectively recycled by utilizing the invented apparatus having a pump and dual filter arrangement. Large particulate matter is effectively removed by the first filter 12 while the second filter 30 and pump 26 combination effectively removes unwanted smaller particulate matter from the slurry.

The second filter 30 may be cleaned or replaced during the continuous operation of the recycling system. During normal operation of the system, the second filter 30 is isolated by reducing or eliminating power to the pump 26 and closing a set of valves 33*a*, 33*b* located on either side of the filter 30, thereby preventing further slurry flow through the second filter. The filter may then be cleaned or replaced without the need to otherwise divert the slurry. While the filter 30 is being replaced, the recycling system continues to operate, with dirty slurry from the edge-notch operation being accumulated and stored in the dirty tank 20, and with clean slurry supplied from the reservoir of clean slurry held in the clean tank 40. Once the filter is successfully replaced, the valves 33*a*, 33*b* are opened and the pump 26 is returned to operational speed. Exchange of a typical slurry filter takes no more than a couple of minutes.

Referring to FIG. 2, in an alternative embodiment, the invented apparatus is configured with two secondary filters 30, 50 arranged in parallel. Thus, the secondary filter 30, valves 33*a*, 33*b*, and piping 32 are all duplicated 50, 52, 53*a*, 53*b*. Use of the dual secondary filters 30, 50 allows circulation of slurry through the apparatus to be maintained even while a filter is being serviced. By alternately opening the set of valves 33*a*, 33*b* associated with one secondary filter 30 and those valves 53*a*, 53*b* associated with a second secondary filter 50, slurry flow may be temporarily diverted from the respective filters, allowing time for the filters to be cleaned or changed, or slurry flow may be indefinitely diverted away from a particular filter, in the event that extended maintenance upon the bypassed filter is necessitated.

Slurry filtrate that has been filtered through the second filter 30 is fed through the clean side supply line 32 to the clean side slurry supply tank 40. As with the dirty tank 20, the clean tank 40 is any specially made or commercially available container which is not abraded by or reactive with the slightly acidic or slightly basic abrasive slurry. When using a sodium hydroxide slurry, the tank is resistant to caustic attack. The clean tank 40 has a volume capable of containing enough slurry to feed the edge-notch polisher for several minutes. During the filter 30 removal process, no slurry is received by the clean tank 40, so there must be enough slurry present in the clean tank 40 to supply the edge-notch polisher until the filter 30 is back on line.

During normal operation, the clean tank 40 is kept full or nearly full. Slurry is removed from the clean side tank 40 and supplied to the edge-notch polisher by polishing pad supply line 42. A valved drain line 44 is also preferably provided to the clean tank 40 for use during maintenance.

Overflow from the clean tank 40 is preferably conducted to the dirty tank 20. In accordance with one possible mode of operation, the pump 26 is operated at a capacity which provides for a constant overflow of slurry from the clean tank 40 to the dirty tank 20. The constant overflow provides two functions. First, if the supply of slurry within the clean tank 40 is more than sufficient to feed the edge-notch polisher, the overflow slurry reenters the dirty tank 20 and is continuously pumped and filtered through the second filter 30, thus removing any oversized particulates not removed in previous passes though the filter 30. Second, constant overflow provides agitation within the tanks and prevents the solids present within the slurry from settling to the bottom of the liquid.

Slurry overflow is provided by any means providing communication from the upper portion of the clean tank 40 to the upper portion of the dirty tank 20. In an alternative embodiment, the clean tank 40 and the dirty tank 20 reside within the bounds of the same physical structure and are separated by a partition 21. In this alternative embodiment, slurry overflow occurs over the partition 21. Note that the secondary drain line 23 of the dirty tank 20 is located lower than the physical position of the slurry overflow to provide for drainage of the slurry in the event that the recycle system is over supplied with slurry, and also to prevent backflow of slurry from the dirty tank 20 to the clean tank 40 upon overfilling of the dirty tank 20.

If the apparatus is equipped with two sets of secondary filters 30, 50, then slurry may be continually supplied to the clean tank 40, even during the exchange of filters. Such an arrangement allows for the continual overflow of slurry from the clean tank 40 to the dirty tank 20 which allows for continual agitation of the slurry, which prevents particulates within the slurry from settling out in the dirty tank 20, even when one of the secondary filters is being changed.

The edge-notch polishing apparatus is tolerant of variations in slurry properties and composition, and uniformity in composition is not nearly as critical as typical chemical mechanical polishing (CMP) operations used to polish the surface of the silicon wafer. Thus, the invented recycling apparatus may be used without the need for ancillary components found in CMP slurry recycling operations, such as pH adjusters, concentration adjusters, and deionization tanks. Nonetheless, pH adjusters, slurry concentration adjusters, and deionization units are alternatively used in line with the slurry recycle apparatus.

The invented slurry recycling system provides a reliable and continuous supply of slurry to an edge-notch polishing apparatus. The invented dual filter apparatus provides for continual filtering and refiltering of the slurry, and allows for cleaning and replacement of the second filter 30 during continued operation of the apparatus. The improved filtration provided by the invention protects sensitive flowmeters and monitoring equipment downstream of the filters, thus minimizing downtime caused by malfunctioning equipment in the polishing process. Further, the invented slurry recycling apparatus and method more effectively filters the slurry and prevents unwanted particulate material from reaching the polishing pad, where it could potentially damage the wafer being polished.

Many modifications and other embodiments of the invention will come to mind to one skilled in the art to which this invention pertains having the benefit of the teachings presented in the foregoing descriptions and the associated drawings. Therefore, it is to be understood that the invention is not to be limited to the specific embodiments disclosed and that modifications and other embodiments are intended to be included within the scope of the appended claims. Although specific terms are employed herein, they are used in a generic and descriptive sense only and not for purposes of limitation.

What which is claimed is:

1. An apparatus for recycling slurry used with an edge-notch polishing apparatus comprising:

a dirty slurry return conduit;

a first screen filter in fluid communication with said dirty slurry return conduit, for removing particulates larger than a first predetermined size from the slurry;

a dirty slurry storage tank downstream of said first screen filter;

a second filter located downstream of said dirty slurry storage tank for removing particulates larger than a second predetermined size from the slurry, wherein the second predetermined size is smaller than the first predetermined size such that the second filter removes smaller particulates than the first filter;

a clean slurry storage tank located downstream of said second filter;

an overflow relief conduit which directs overflow from the clean slurry storage tank into the dirty slurry storage tank; and, a clean slurry supply conduit leading from said clean slurry supply tank.

2. The apparatus for recycling slurry of claim 1, further comprising an overflow drain disposed within the dirty slurry storage tank, whereby the overflow drain prevents accumulated slurry in the dirty slurry storage tank from backflowing through the overflow relief conduit.

3. The apparatus for recycling slurry of claim 1, wherein the clean slurry storage tank and the dirty slurry storage tank are portions of a single vessel separated by a partition having a top edge, wherein the top edge of the partition acts as the overflow relief conduit.

4. The apparatus for recycling slurry of claim 1, wherein said second filter is removable.

5. An apparatus for recycling slurry used with an edge-notch polishing apparatus comprising a dirty slurry return conduit;

a first screen filter in fluid communication with said dirty slurry return conduit, for removing particulates larger than a first predetermined size from the slurry;

a dirty slurry storage tank downstream of said first screen filter;

a second filter located downstream of said dirty slurry storage tank for removing particulates larger than a second predetermined size from the slurry, wherein the second predetermined size is smaller than the first predetermined size such that the second filter removes smaller particulates than the first filter, and wherein said second filter is removable;

a slurry pump located between said dirty slurry storage tank and said second filter;

a clean slurry storage tank located downstream of said second filter;

a first valve located between the pump and the second filter, and a second valve located between the second filter and the clean slurry storage tank, whereby the removable second filter may be temporarily isolated by closing the first and second valves; and, a clean supply conduit leading from said clean slurry supply tank.

6. The apparatus for recycling slurry of claim 5, wherein the slurry pump provides increased slurry pressure of at least 5 pounds per square inch.

7. The apparatus for recycling slurry of claim 6, wherein the slurry pump provides a slurry flow rate of between about 0.4 and 2.0 liters per minute.

8. The apparatus for recycling slurry of claim 5, further comprising at least one device selected from a group consisting of pH adjusters, slurry concentration adjusters, deionization units, and combinations thereof.

9. The apparatus for recycling slurry of claim 5, wherein said first filter removes particulates of at least 0.2 mm.

10. The apparatus for recycling slurry of claim 5, wherein said first filter removes particulates of at least 0.4 mm.

11. The apparatus for recycling slurry of claim 5, wherein said second filter removes particulates of at least 10 μm.

12. The apparatus for recycling slurry of claim 5, wherein said second filter removes particulates of at least 20 μm.

13. The apparatus for recycling slurry of claim 5, further comprising an additional filter having an inlet and outlet and valves at the inlet and outlet of the additional filter, wherein said additional filter resides in parallel to said second filter, and wherein said additional filter also removes particulates of a second predetermined size.

14. A slurry recycling apparatus, comprising:

a first screen filter for removing particulates larger than about 0.4 mm from the slurry;

a dirty slurry storage tank downstream of said first screen filter for containing the slurry filtrate of the first filter;

a slurry pump downstream of said dirty slurry storage tank which provides slurry flow of at least 0.4 liters per minute at a pressure of at least 5 psi;

a second filter located downstream of said dirty slurry storage tank for removing particulates larger than about 20 μm from the slurry, a clean slurry storage tank located downstream of said second filter for containing slurry filtrate of the second filter;

an overflow conduit for conducting overflow slurry from the clean slurry storage tank to the dirty slurry storage tank; and a clean slurry supply conduit leading from said clean slurry supply tank for supplying slurry to the edge-notch polishing apparatus.

15. A process of recycling slurry used with an edge-notch polishing (ENP) apparatus, said process comprising the steps of:

providing recycled slurry from an ENP operation;

filtering said slurry through a first filter and removing particulates larger than a first predetermined size from the slurry;

storing the first slurry filtrate in a dirty slurry storage tank;

pumping the slurry from the dirty slurry storage tank through a secondary filter and removing particulates larger than a second predetermined size from the slurry, wherein the second predetermined size is smaller than the first predetermined size such that the second filter removes smaller particulates than the first filter;

storing said second slurry filtrate in a clean slurry storage tank; and, releasing slurry from the clean slurry storage tank while directing slurry overflow from the clean slurry storage tank to the dirty slurry storage tank.

16. The process of recycling slurry as in claim 15, wherein the step of directing slurry overflow from the clean slurry storage tank to the dirty slurry storage tank comprises providing a constant overflow of slurry from the clean slurry storage tank into the dirty slurry storage tank.

17. The process of recycling slurry as in claim 15, further comprising regularly removing and cleaning said secondary filter.

18. The process of recycling slurry as in claim 15, wherein the filtering of the slurry through the first filter involves removing particulates larger than about 0.2 mm from the slurry.

19. The process of recycling slurry as in claim 18, wherein the filtering of the slurry through the first filter involves removing particulates larger than about 0.4 mm from the slurry.

20. The process of recycling slurry as in claim 15, wherein the filtering of the slurry through a second filter involves removing particulates larger than about 10 μm from the slurry.

21. The process of recycling slurry as in claim 20, wherein the filtering of the slurry through a second filter involves removing particulates larger than about 20 μm from the slurry.

22. A process of recycling slurry used with an edge-notch polishing (ENP) apparatus, said process comprising the steps of:

providing recycled slurry from an ENP operation;

filtering said slurry through first filter and removing particulates larger than a first predetermined size from the slurry;

storing the first slurry filtrate in a dirty slurry storage tank;

pumping the slurry from the dirty slurry storage tank through secondary filter and removing particulates larger than a second predetermined size from the slurry, wherein the second predetermined size is smaller than the first predetermined size such that the second filter removes smaller particulates than the first filter;

storing said second slurry filtrate in a clean slurry storage tank;

releasing slurry from the clean slurry storage tank; and, regularly removing and cleaning said secondary filter by reducing the output of the slurry pump, whereby slurry is accumulated in said dirty tank;

isolating the second filter from the slurry pump and the clean tank, whereby the ENP is supplied with stored slurry from the clean tank;

servicing said second filter;

bringing the filter back in-line with the slurry pump and the clean tank; and restoring the output of the slurry pump.

23. A process of recycling slurry used with an edge-notch polishing (ENP) apparatus, said process comprising the steps of:

providing recycled slurry from an ENP operation;

filtering said slurry through a first filter and removing particles larger than a first predetermined size from the slurry;

storing the first slurry filtrate in a dirty slurry storage tank;

filtering said slurry through a secondary filter and removing particulates larger than a second predetermined size from the slurry, wherein the second predetermined size is smaller than the first predetermined size such that the second filter removes smaller particulates than the first filter;

storing said second slurry filtrate in a clean slurry storage tank;

releasing slurry from the clean slurry storage tank; and, regularly removing and cleaning said secondary filter by alternately directing slurry flow through one secondary filter or an additional secondary filter residing in parallel with the first secondary filter, and removing or cleaning the filter through which no slurry is flowing.

* * * * *

UNITED STATES PATENT AND TRADEMARK OFFICE

CERTIFICATE OF CORRECTION

PATENT NO. : 7,059,943 B2
APPLICATION NO. : 09/893928
DATED : June 13, 2006
INVENTOR(S) : Cann et al.

It is certified that error appears in the above-identified patent and that said Letters Patent is hereby corrected as shown below:

Column 9,
Line 23, after "through", insert --a--.

Column 10,
Line 14, "particles" should read --particulates--.

Signed and Sealed this

Fifth Day of December, 2006

JON W. DUDAS
*Director of the United States Patent and Trademark Office*